US008348300B2

(12) United States Patent
Karlsen

(10) Patent No.: US 8,348,300 B2
(45) Date of Patent: Jan. 8, 2013

(54) SNOWBOARD AND SKIS

(75) Inventor: Jørgen Karlsen, Høvik (NO)

(73) Assignee: HiTurn AS, Raufoss (NO)

( * ) Notice: Subject to any disclaimer, the term of this patent is extended or adjusted under 35 U.S.C. 154(b) by 1080 days.

(21) Appl. No.: 12/161,865

(22) PCT Filed: Feb. 16, 2007

(86) PCT No.: PCT/NO2007/000061
§ 371 (c)(1),
(2), (4) Date: Oct. 22, 2008

(87) PCT Pub. No.: WO2007/094690
PCT Pub. Date: Aug. 23, 2007

(65) Prior Publication Data

US 2009/0273162 A1 Nov. 5, 2009

(30) Foreign Application Priority Data

Feb. 16, 2006 (NO) ..... 20060758
Feb. 15, 2007 (NO) ..... 20070873

(51) Int. Cl.
*A63C 5/044* (2006.01)

(52) U.S. Cl. ..... 280/609; 280/14.22

(58) Field of Classification Search ..... 280/14.21, 280/601, 602, 607, 608, 609, 11.18
See application file for complete search history.

(56) References Cited

U.S. PATENT DOCUMENTS 3,326,564 A 6/1967 Heuvel
5,018,760 A * 5/1991 Remondet ..... 280/609
5,462,304 A * 10/1995 Nyman ..... 280/609
5,511,815 A 4/1996 Karlsen
5,876,056 A 3/1999 Karlsen

FOREIGN PATENT DOCUMENTS

DE 24 03 944 8/1975
DE 26 47 125 A1 4/1978
DE 87 05 677 U1 8/1988
DE 198 09 005 A1 9/1999
DE 100 12 155 A1 12/2001

(Continued)

OTHER PUBLICATIONS

Norwegian Search Report.

(Continued)

*Primary Examiner* — J. Allen Shriver, II
*Assistant Examiner* — Bridget Avery
(74) *Attorney, Agent, or Firm* — Merchant & Gould P.C.

(57) ABSTRACT

The tips are upwardly curved and the board's/ski's underside (the sole) is provided with first and second surfaces, straight in cross section, extending in the board's/ski's longitudinal direction, which are arranged at an angle to each other and usually interconnected via a third surface. The sole's first and second sole surfaces (2) at the lateral edge, which normally consists of a steel edge, have a varying height over a third sole surface (1), where this height typically both increases and decreases as one advances from the middle of the snowboard/ski towards the transition to the tip (A-A). At the same time the first and second sole surfaces (2) at the lateral edge substantially have a greater height over the third surface (1) in a 10 cm long area from the transition (A-A) and backwards than in the area forming the central half of the snowboard/ski.

15 Claims, 15 Drawing Sheets

FOREIGN PATENT DOCUMENTS

| | | | |
|---|---|---|---|
| EP | 0 253 660 | A2 | 1/1988 |
| EP | 1 338 312 | A1 | 8/2003 |
| NO | 301964 | | 1/1998 |
| WO | WO 95/21662 | | 8/1995 |
| WO | WO 98/42418 | | 10/1998 |
| WO | WO 99/46016 | | 9/1999 |
| WO | WO 03/095040 | A1 | 11/2003 |
| WO | WO 2006/049508 | A1 | 5/2006 |

OTHER PUBLICATIONS

Austrian Office Action.

* cited by examiner

Fig.13A-F,14A-F.
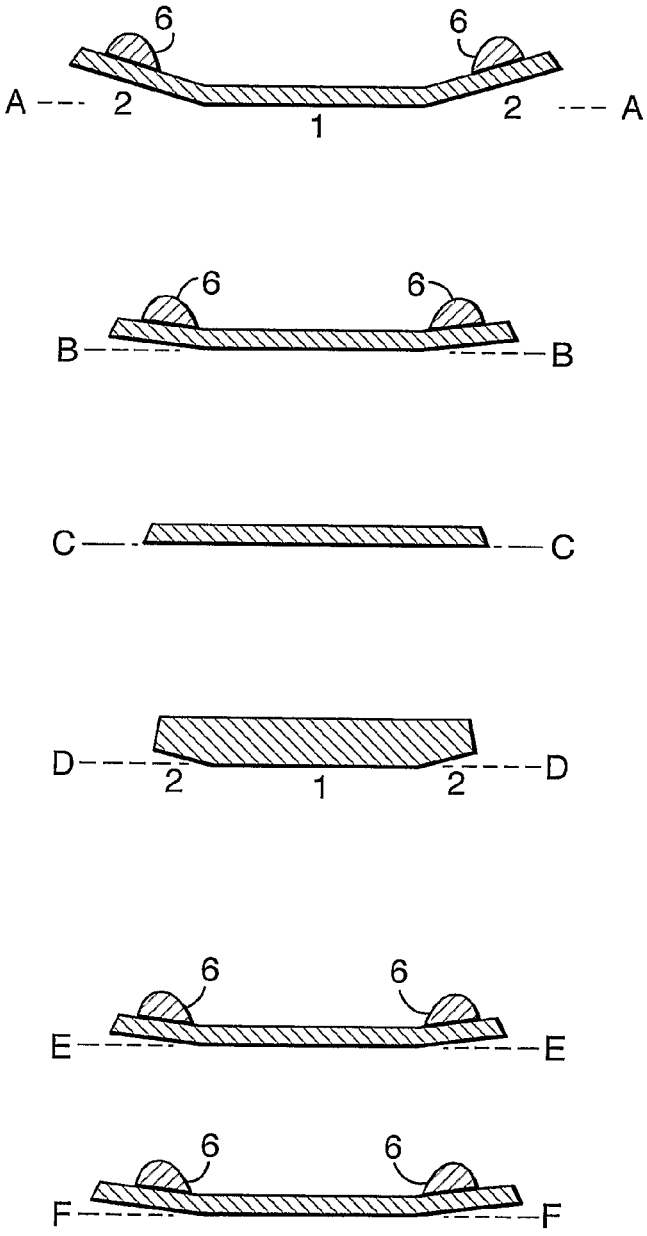
Fig.15.
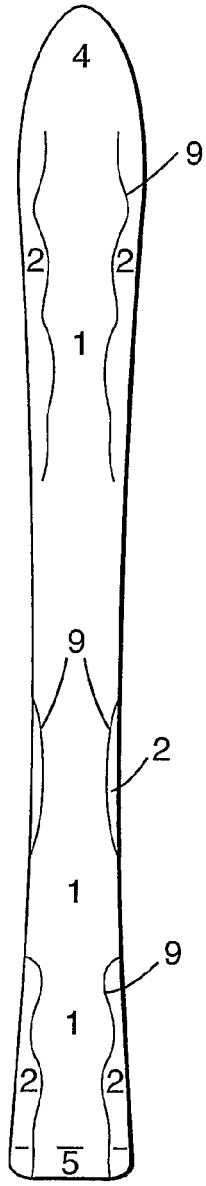

SNOWBOARD AND SKIS

The invention relates to a snowboard or ski of the type indicated in the introduction to claim 1.

Snowboards/skis today are normally designed with a flat surface between the tips at the two ends. The sliding surface today is normally composed of a flat sole surface between the tips at the two ends. For steering, the board is edged and the weight is distributed over the board's sliding surface by adapting the camber.

From international patent application WO 99/46016 a snowboard is known with a sole wholly or partly divided into three sliding surfaces. In this application the sole is described with a substantially flat central portion with an increasing angle between the flat portion and a sloping sole portion as one approaches the tip. For several reasons this is not optimal for all applications.

Similarly, from Norwegian patent no. 301964 a ski is known with a sole wholly or partly divided into three sliding surfaces. In this patent the sole is described with a substantially flat portion with an increasing angle between the flat portion and the sloping base portion when moving towards the tips. On testing the known models of skis and snowboards, it has been found that they offer limited opportunities for adaptation to different surface conditions and for use on different types of surface.

Based on the above-mentioned prior art, therefore, it is an object of the present invention to provide a snowboard or ski which is better able to be adapted to the different conditions and the challenges this implies, as well as more reliable transitions when skiing on harder surfaces.

This is achieved with a snowboard/ski which is characterised by the features which will become apparent from the patent claims.

Since the examples of snowboards and skis described below have many features in common, for the sake of simplicity only the generic term board or snowboard is employed, except where the features are adapted for use on skis. The use of these terms is therefore not intended to be limiting. The object of the invention, which is to provide an improved snowboard/ski, is achieved by means of the special design of the sliding surfaces. In the middle the board is either completely flat (then the angle is 0) or the sliding surface with a steel edge will form a relatively small angle with each other when viewed in cross section and the lines are extended from the outermost sliding surfaces so that they intersect and it is the acute angle, which the outermost sole with one of the steel edges forms with the corresponding outermost sole on the opposite side, viewed in cross section, substantially increases forwards towards the board's widest portion at the transition to the tip. When we say that the angle increases, we mean here that an acute angle between the two outermost surfaces on each side is substantially increasing from the middle of the ski/snowboard towards each of the tips. The angle represented by the outermost sliding surfaces is the sum of all the angles, so that it can also be said that this sum substantially increases from the middle towards each of the tips.

Another way of achieving approximately the same functionality is to use at least two sliding surfaces which are straight in cross section, but where these straight parts of the sole, viewed in cross section, do not merge into one another, but there is a sole surface which is cambered in cross section between the straight sole surfaces.

A substantial potential for improvement has therefore been achieved by providing a ski or a snowboard with a cambered or curved middle surface, respectively a board with more than three sliding surfaces. A larger angle to the ground is therefore obtained with the steel edge than if only three surfaces are used. By using several sliding surfaces, the angle and width of the sliding surface can be optimised according to different conditions. There may, for example, be five sliding surfaces for the first 15 centimetres, followed by three sliding surfaces for the next 20 centimetres, subsequently a sliding surface in the middle, and then the rear part can be made symmetrical with the front part or the sliding surfaces may be varied according to experience in order to achieve the best dynamic in the conditions aimed for. In this way different applications can be optimised from performing in icy half-pipes to racing or for use in new snow. The basic profile for all kinds of snow conditions is at the front and rear, and therefore it is in the board's wide portions that the board has the greatest tendency to cut down into the snow when edged. Thus it is important that the board's outermost sliding surfaces form a substantially increasing angle with each other when moving from the middle of the board, viewed in the longitudinal direction, so that the sliding surface that cuts down into the snow always forms a smaller angle with the base in the board's wide portion compared with the angle with the base on the board's central portion.

It makes little difference to the concept whether the board/ski is symmetrical or not, either in relation to the longitudinal axis or the transversal axis. It may, for example, have five sliding surfaces in front, followed by three, subsequently a flat central portion and then only three sliding surfaces on the whole rear portion or vice versa.

For a snowboard that is to be used on rails, it is advantageous for the steel edges to be located slightly higher than the flat first sole portion between the bindings, thereby preventing the steel edge from being caught in uneven patches in the rail, causing the rider to fall forwards. An important adaptation to this need will therefore be to make a snowboard that has a certain angle between the secondary sole surfaces and the flat first sole portion and the middle, i.e. between the bindings on the snowboard or under the bindings on the ski. Here it may be advantageous to make the raised portions narrow, but in order to obtain sufficient height on the lateral edge, a relatively large angle may be used, considerably larger than that used at the transition to the tip. Even with a raised lateral edge there is a need for a certain amount of steering when riding on a flat surface. To achieve this, the secondary sole surface is allowed to level out when moving slightly forwards and backwards from this cross section, thereby obtaining steel edges there that are completely or almost in the same plane as the flat first sole portion. There is also a wish, however, to have the dynamic benefits obtained by letting the angle between the secondary sole surfaces increase when approaching the tips of the board. A snowboard is thereby obtained that has greater uplift in the lateral edge in the middle of the board than towards the bindings, where the board is either completely flat or almost flat across its entire width before increasing uplift to the lateral edges again towards the transition to the tips. There are boards where the steel edge between the bindings goes inwards and follows the transition between the flat portions and the sloping lateral areas. In the case of such boards the steel edge is not raised in the middle, but none the less a sloping lateral portion of the sole is used in the middle where the outer edge of these sloping lateral areas is raised.

For skis that are to be used on rails, it is advantageous for the steel edges to be located slightly higher than the flat first sole portion under the binding, thus preventing the steel edge from being caught in uneven portions in the rail, causing the rider to fall forwards. An important adaptation to this need will therefore be to make skis with a certain angle between the secondary sole surface and the flat first sole portion in the middle, i.e. under the bindings on the skis. There is also a need here for a certain amount of steering even when skiing on a flat surface. To achieve this, the secondary sole portion is allowed to level out when moving forwards and backwards from this transverse section, thereby giving steel edges which to a greater extent are in the same plane as the flat first sole portion approximately in the front edge and rear edge of the bindings. There is also a wish, however, to have the dynamic benefits obtained by letting the angle between the secondary sole surfaces increase when approaching the tip, possibly also the rear tip. Skis are thereby obtained that have a greater uplift in the lateral edges under the binding than in front of and behind the bindings, where the ski is either completely flat or almost flat across its entire width before increasing the uplift in the lateral edges again towards the transition to the tips. There are skis where the steel edge under the bindings goes inwards and follows the transition between the flat 1. sole portion and the sloping lateral areas. In the case of such skis the steel edges are not raised in the middle, but none the less a sloping lateral portion of the sole is used in the middle where the outer edge of these lateral areas is raised.

A second relevant snowboard embodiment is provided when the stiffening involved in the bindings is taken into consideration and a slightly larger angle is therefore incorporated between the flat part of the board and the secondary sliding surfaces in the area of the binding attachments.

A third relevant embodiment is for riding on icy surfaces where slight undulations are made in the sole, with the result that the steel edge digs down better into the icy surface. This means that alternately increasing and decreasing angles are obtained as one moves from the middle to the tips, or alternatively alternately increasing and decreasing raising of the steel edge as one moves from the middle towards the tip.

The invention will now be described in greater detail by means of embodiments which are illustrated in the drawings. Even though the invention applies to both snowboards and skis, the principle is most frequently illustrated in more snowboard-like drawings and only FIGS. 4, 9, and 13-14 have dimensions typical for skis.

All the figures on the left are shown viewed from the underside, for the invention relates to the geometry of the sliding surface. On the right are shown corresponding cross sections from the sole. For the sake of simplicity a board is illustrated with a sandwich construction on the upper side of the board, viewed in cross section and parallel to the underside. However, this is not necessary as the upper side of the board may be designed differently from the sliding surface. The main task in the engineering of the board's thickness and choice of material is to provide a certain stiffness and torsional rigidity, but this is not a feature that falls within the invention. It is particularly important to make the board flat on the top where the bindings are fastened.

The drawings are as follows:

FIG. 1 is an example of a board according to the invention with several sliding surfaces, FIG. 2 illustrates an asymmetrical board with several sliding surfaces according to the invention, FIG. 3 is a third embodiment of the invention, FIG. 4 illustrates a ski with several sliding surfaces according to the invention, FIG. 5 illustrates a board with two sliding surfaces which are straight in cross section, nearest the steel edge with a curved sliding surface between them, FIG. 6 illustrates a board according to a further embodiment of the invention, FIG. 7 illustrates a board of an asymmetrical type according to the invention, FIG. 8 is yet another embodiment of the invention, FIG. 9 is an alternative design of a ski with a sliding surface according to the invention, FIG. 10 illustrates a snowboard according to the invention, particularly well-suited for rails, FIG. 11 is an embodiment of the invention with an undulating edge area with an extra raised portion at the bindings, FIG. 12 is an alternative embodiment with the same principle as that illustrated in FIG. 10, particularly well-suited for rails, FIG. 13 is a ski viewed from above illustrating the position of the special auxiliary profiles, FIG. 14 illustrates the same ski from the sole side, with a corresponding principle for skis on rails to that illustrated for a snowboard in FIGS. 10 and 12, FIGS. 13-14*a-f* illustrate cross sections of the same ski with sole form for rails and auxiliary profile on the top over the secondary sole surfaces, FIG. 15 illustrates that the transitions between the portions are not necessarily rectilinear, FIG. 16 illustrates some additional kinds of auxiliary strips for sanding.

MORE DETAILS ON THE FIGURES

FIG. 1*a* illustrates the underside of a board that has five sliding surfaces in the transition to the tips, three sliding surfaces slightly closer to the middle and only one common sliding surface on the central portion, followed by three sliding surfaces and then five sliding surfaces at the rear. FIGS. 1*b-d* show different cross sections of this board. The board in FIG. 1 is illustrated with a different shape on the front and rear portions and there may often be dynamic reasons for the different shape at the front and rear, even though there is usually the same shape at both ends if the board is also symmetrical about its central transversal axis.

FIG. 2*a* illustrates the underside of an asymmetrical board which has five sliding surfaces at one tip (in principle it is optional whether it is the front tip or rear tip), and then three sliding surfaces on the rest of the board. FIGS. 2*b-d* illustrate different cross sections of the same board.

FIG. 3*a* illustrates the underside of a board that has three sliding surfaces at one tip and a common sliding surface in the central portion, followed by three and then four sliding surfaces towards the other tip. FIGS. 3*b-e* illustrate different cross sections of the same board.

FIG. 4*a* illustrates the underside of a ski that has five sliding surfaces closest to the front tip, followed by three sliding surfaces as one approaches the binding attachments, and only one common sliding surface on the central portion and then three sliding surfaces on the rear part of the ski. FIG. 4*b* illustrates a slightly enlarged cross section of the ski in section A-A.

FIG. 5*a* illustrates the underside of a board with two sliding surfaces which are straight in cross section, nearest the steel edge and a curved sliding surface between them. Between the bindings the board is completely flat. FIGS. 5*b-d* illustrate different cross sections of the same board. It should be noted that between the lines (11, 12) the board is curved, thereby avoiding the need for any pronounced break points, viewed in cross section (one may still choose to have both break points and curved portion).

FIG. 6*a* illustrates the underside of a board with three sliding surfaces which are straight in cross section, but where there are additional curved sliding surfaces between the sliding surfaces that are straight in cross section, with the result that the board consists of three straight and two cambered sliding surfaces, viewed in cross section. FIGS. 6*b-d* illustrate different cross sections of the same board. It should be noted that between the lines (11, 12) and between the lines (13, 14) the board is curved, thereby avoiding the need for any pronounced break points, viewed in cross section.

FIG. 7*a* illustrates the underside of a board that has four sliding surfaces asymmetrically about the longitudinal axis nearest the tips, followed by three sliding surfaces as one approaches the binding attachments and only one common sliding surface on the central portion. On the rear portion the board again has three sliding surfaces. FIG. 7*b* illustrates an enlarged cross section A-A.

FIG. 8*a* illustrates the underside of a board that has five sliding surfaces in front, followed by three, subsequently one and then three sliding surfaces at the rear.

FIG. 8*b* illustrates an enlarged cross section A-A.

FIG. 9 and FIGS. 9*b*-9*d* illustrate the same principle for a ski.

FIG. 10 illustrates a snowboard according to a further embodiment of the invention, viewed from the sole side where the lines show the transition between the first sole surfaces and the rest of the board.

The figures with the sections on the right illustrate possible cross sections. The cross sections illustrate a snowboard specially adapted for running on rails with less risk of being caught in the middle since the edges are raised as shown in cross section M-M, the uplift towards D and N is then reduced, before increasing again from C and G with slightly more uplift in B and H and even more uplift in A and I.

The shape of the top affects the strength of the board and is of great importance, but is illustrated here only as flat, since in principle it may have a great many shapes within approximately the same functionality, and it can be used for adapting stiffness, torsional rigidity, etc.

FIG. 11 illustrates a snowboard according to the invention where the lines show the transition between the first sole surface and the rest of the board. The figures on the right illustrate possible cross sections. The cross sections illustrate a snowboard that compensates for the stiffness round the bindings by having an extra uplift on the lateral edges in the secondary areas at the binding attachments, cross section in D and O. In towards the middle, the board is flat over its entire width, as cross section in E, M, N. From D and O towards the tips, the uplift first decreases slightly, see cross sections C and P which depict less uplift of the lateral edge than the cross sections in D and O. From C and P the uplift increases forwards/backwards to B/Q and further increases until the transition to the tips A/X. Here too the shape of the top is only illustrated as flat, but may be and usually is different.

FIG. 12 illustrates a snowboard according to the invention viewed from the sole side, where the lines show the transition between the first sole surface and the rest of the board. In order to illustrate some possibilities for variation, three different widths are used on the sole portion where at the same time there is a raised, outer, secondary sole portion. The board is approximately symmetrical about the longitudinal axis, but this is not necessary. The sections on the right side of the figure indicate the sliding surface. The cross sections illustrate a snowboard that has a slightly varying degree of uplift in the lateral edge that creates very special dynamic characteristics, but where the uplift in the lateral edge is substantially increasing from the bindings towards the tips. In some cases the variation in the cross sections is so moderate that it is difficult to show in the drawing, and the angle is therefore slightly exaggerated in order to illustrate the point. Only the cross section of XX is shown with the board's thickness. The following uplift for the lateral edge in millimetres is given as a possible example: A=7, B=5, C=5.5, D=3, E=3.5, F=1, G=0, M=2, N=0, O=1, P=2.5, Q=2, R=4, S=3.5, X=5.5.

FIG. 13 illustrates a ski according to the invention viewed from the top, where the lines show break points and the hatched area is the raised portions (auxiliary profile) on the top for simplifying and improving the sanding of the skis at ski service.

FIG. 14 illustrates the same ski as in FIG. 13 viewed from the underside, where the lines show the transition between the first sole surface and the rest of the board. On the right side of the drawing are illustrated possible cross sections for both designs. The underside of the cross sections illustrates a ski specially adapted for running on rails with less risk of being caught in the middle, since the lateral edge is raised as illustrated in cross section M, and then the uplift towards C and N is reduced, before again increasing towards G and O with even more uplift in A and X, where the final raised portion is conditional on the desire for a good dynamic during normal running. The top of the cross sections shows an extra profile over the secondary lateral area in front and at the rear but not in the middle, where they provide an easier and more precise sanding of the boards. The profile is drawn here placed on the ski and therefore removable, but it can just as well be integrated in the ski. If it is removable, in principle it can be sent with only one piece in front and one at the rear and then one can always run without and take it along to ski service when the ski has to be sanded or ski service has them and can mount them.

FIG. 15 illustrates the sole surface on a ski, where the break points (9) between the individual sole surfaces are typically not straight lines.

DESIGNATIONS IN THE FIGURES

Figure 1A:
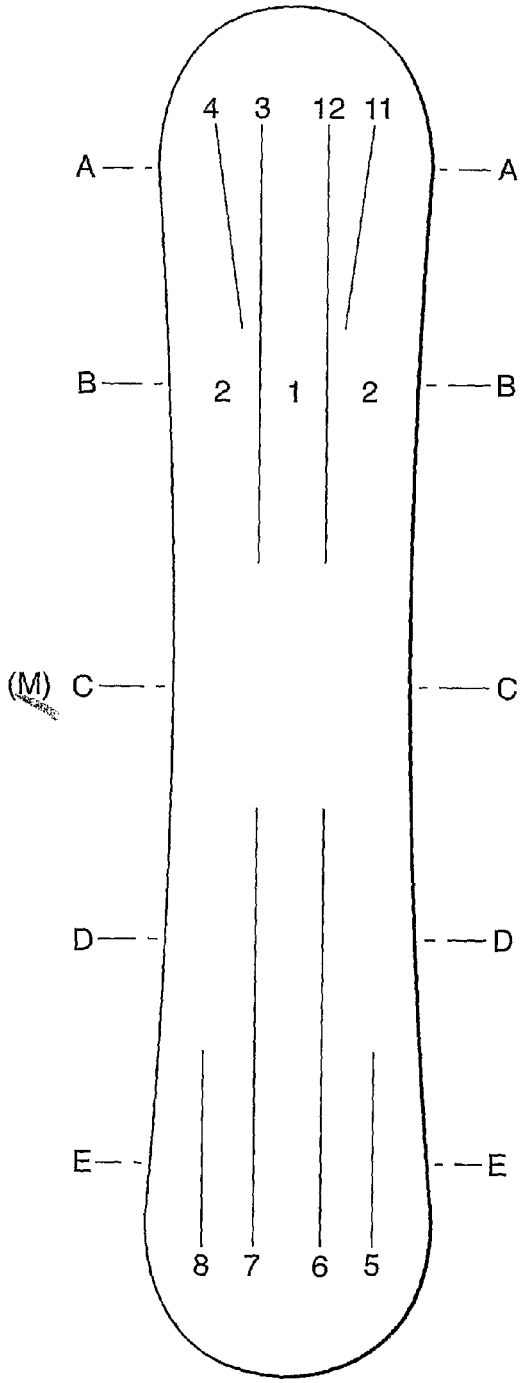
Figure 1B:
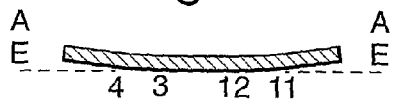
Figure 1C:
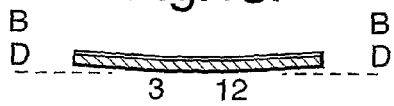
Figure 1D:
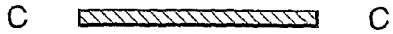
Figure 2A:
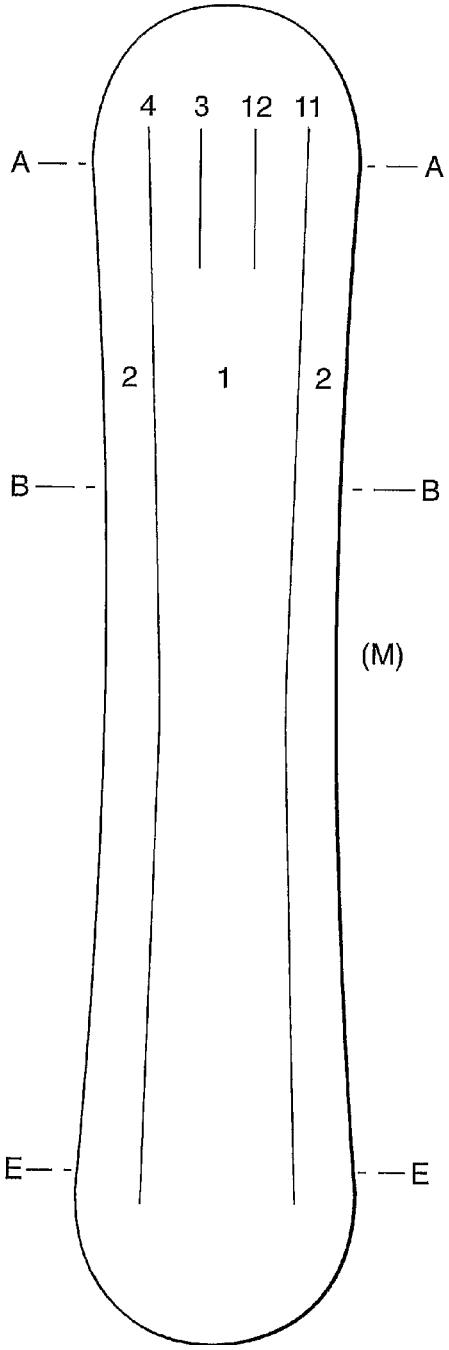
Figure 2B:
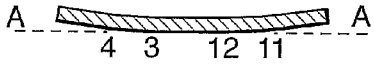
Figure 2C:
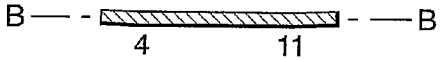
Figure 2D:
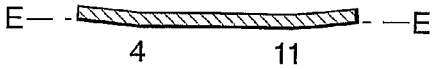
Figure 3A:
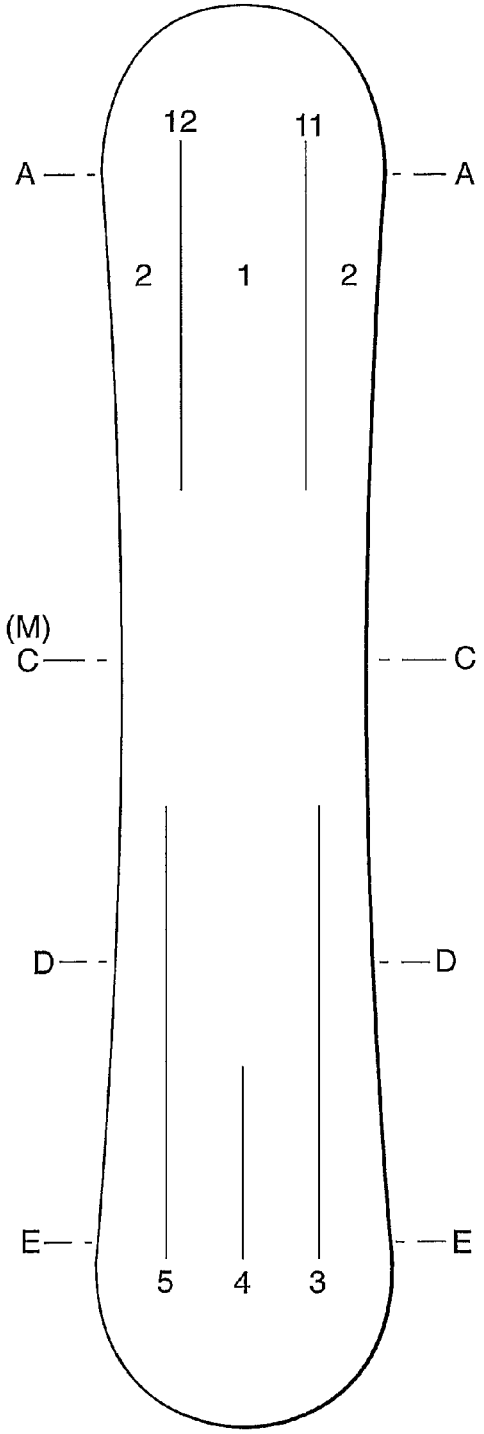
Figure 3B:
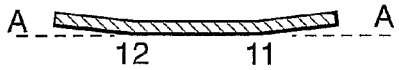
Figure 3C:
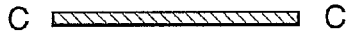
Figure 3D:
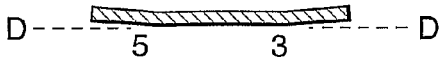
Figure 3E:
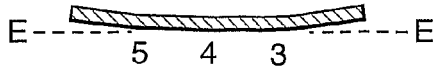
Figure 4A:
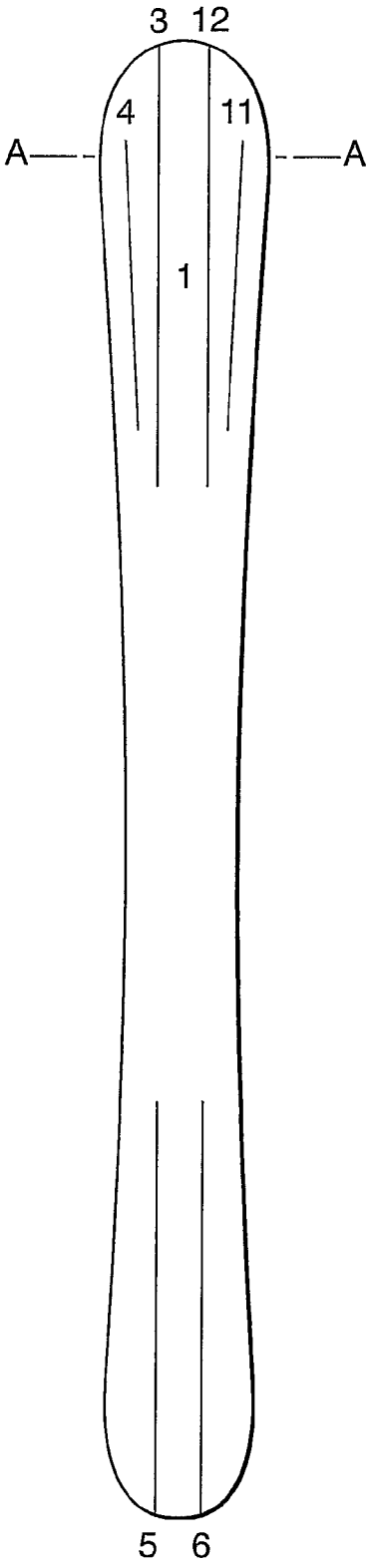
Figure 4B:
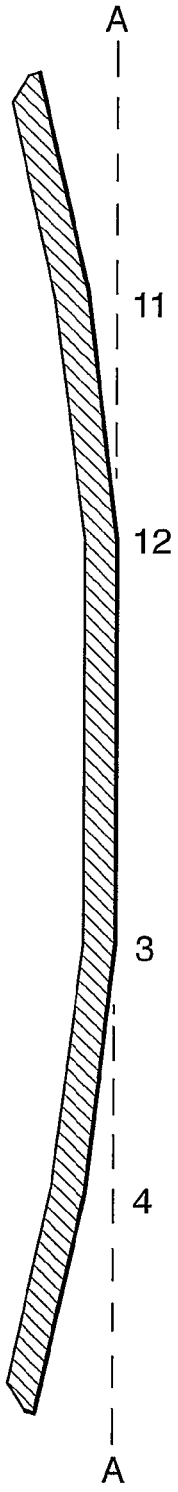
Figure 5A:
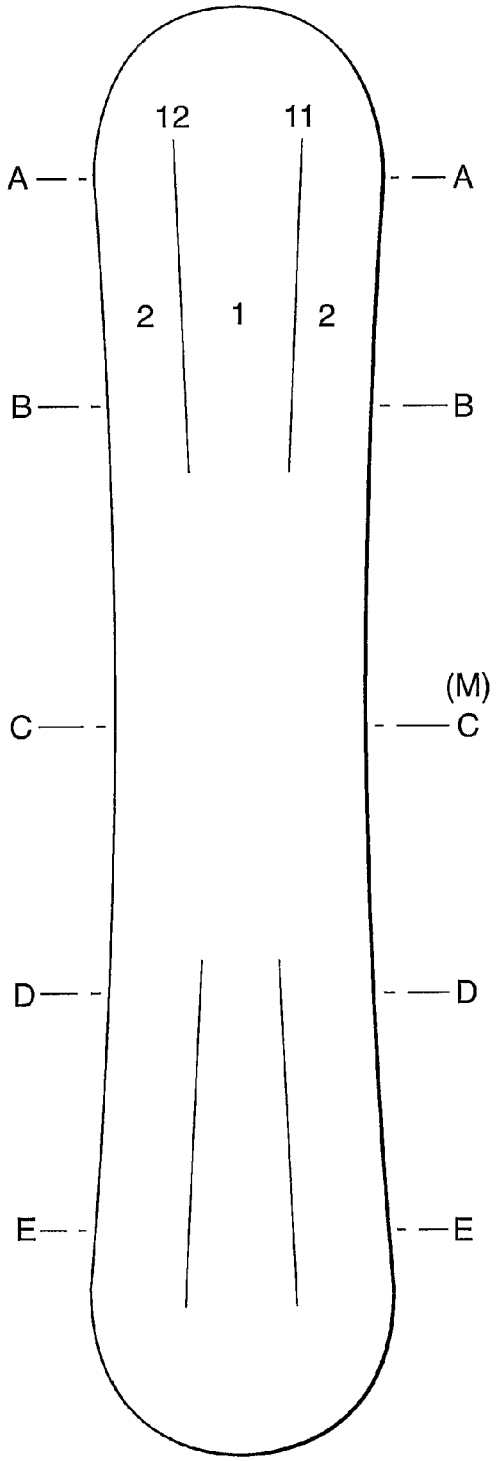
Figure 5B:
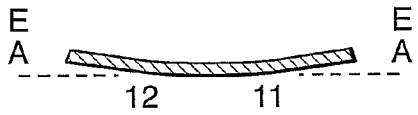
Figure 5C:
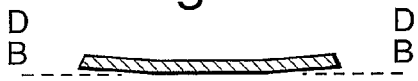
Figure 5D:
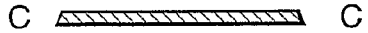
Figure 6A:
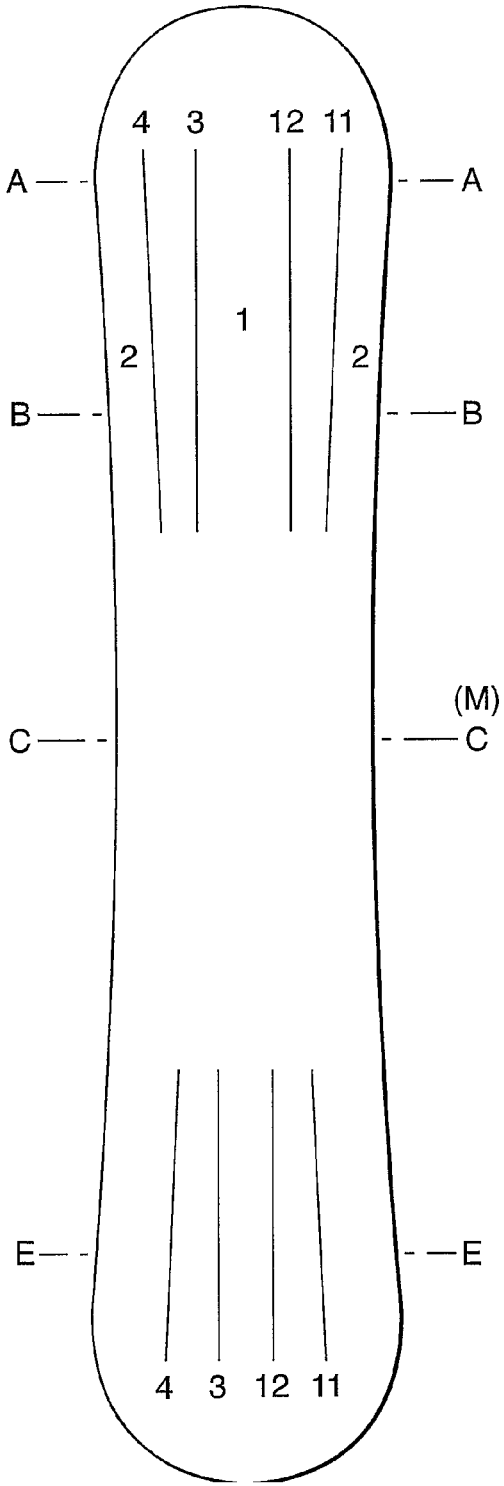
Figure 6B:
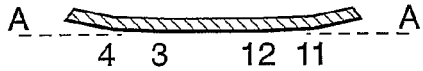
Figure 6C:
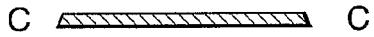
Figure 6D:
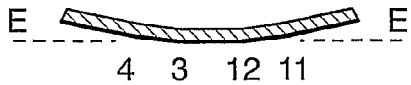
Figure 7A:
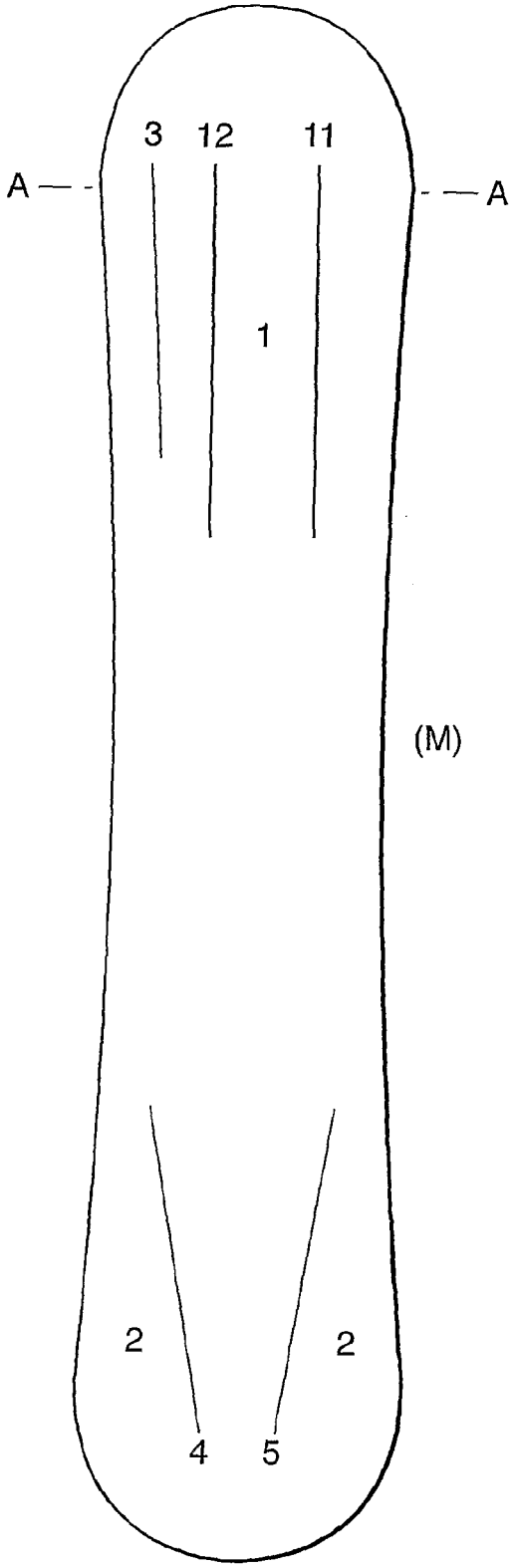
Figure 7B:
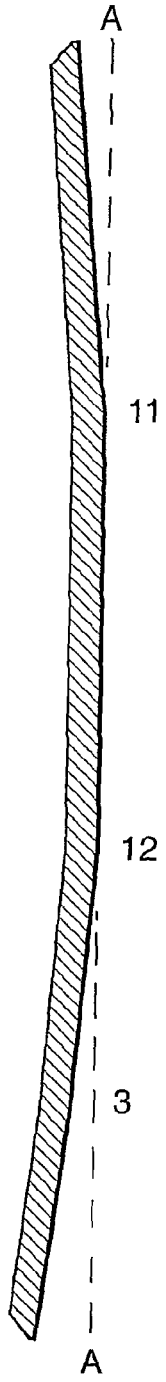
Figure 8A:
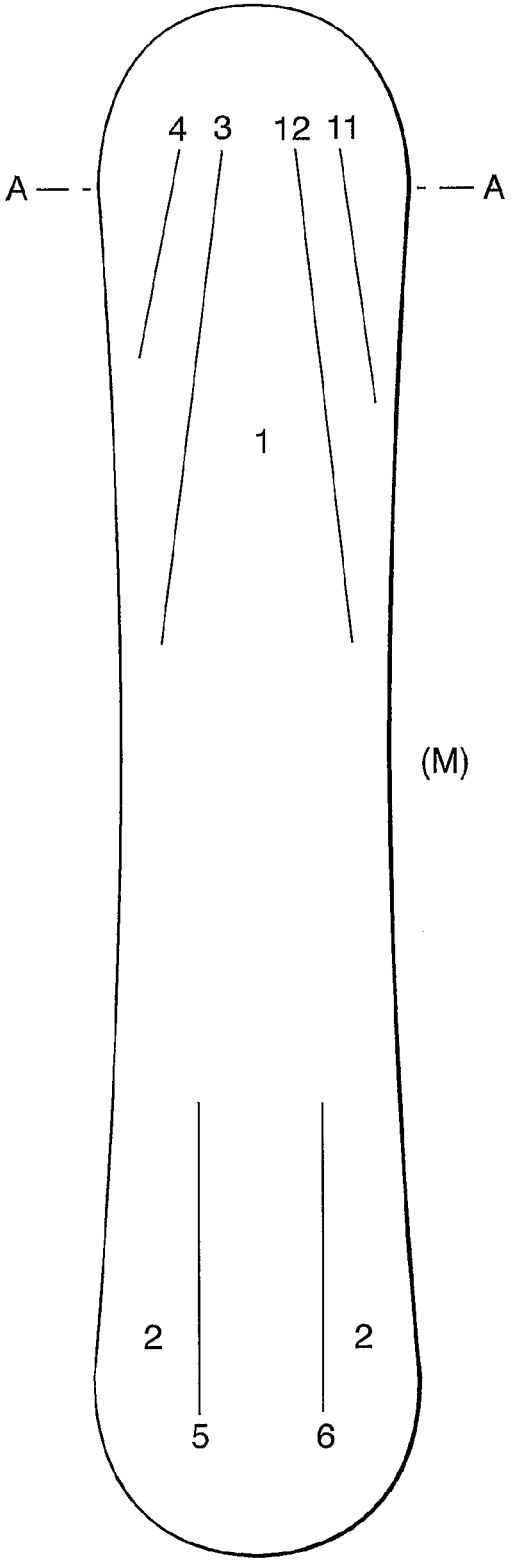
Figure 8B:
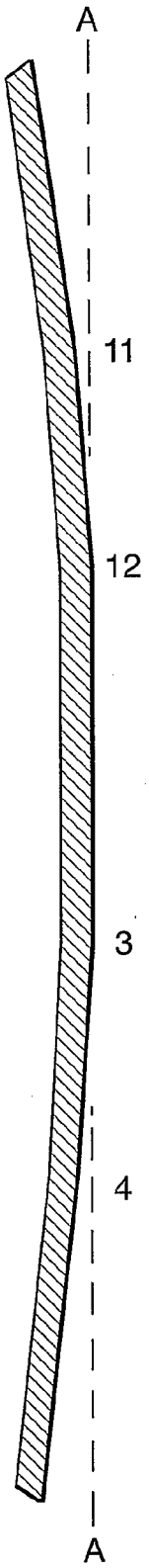
Figure 9A:
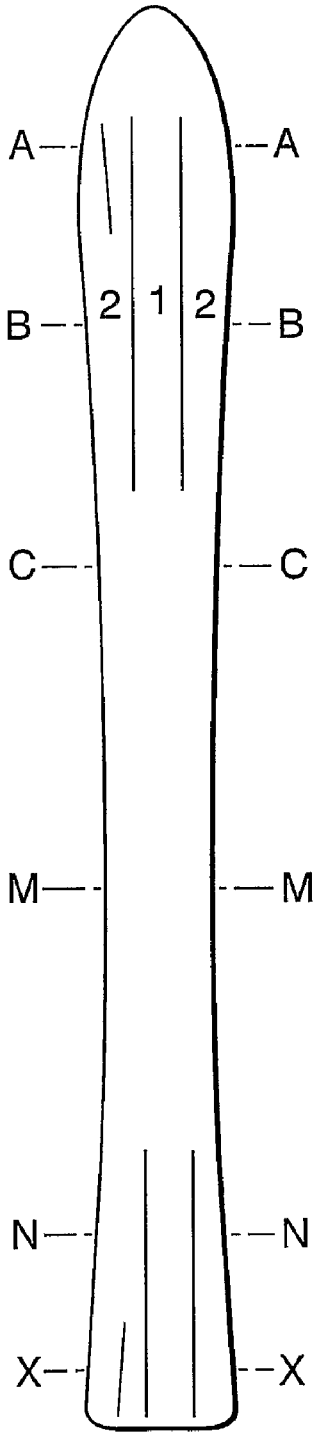
Figure 9B:
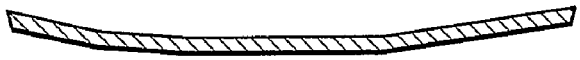
Figure 9C:
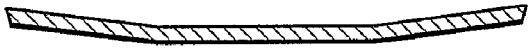
Figure 9D:
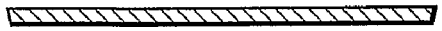
Figure 10:
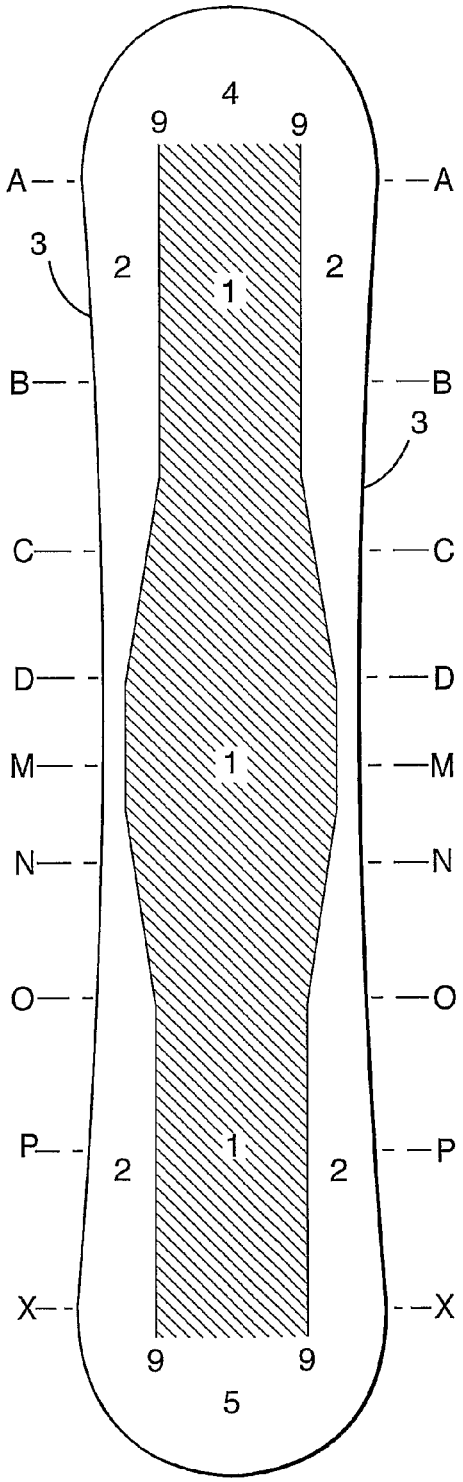
Figure 10A:
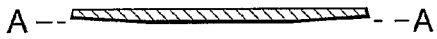
Figure 10B:
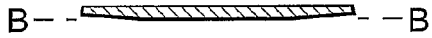
Figure 10C:
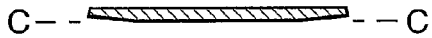
Figure 10D:
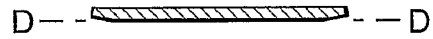
Figure 10E:
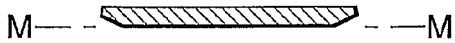

1. third sole surface (equal to central sliding surface)
2. secondary lateral area (also called 1. and 2. sole surface)
3. lateral edge (usually a steel edge)
4. front tip
5. rear tip
6. auxiliary profile
7. nut insert
8. screw
9. line dividing different sole areas (also 11, 12, 13, 14, 15, 16, 17, 18)
10. hatching in the sole indicates completely flat sole portion.

Figure 11:
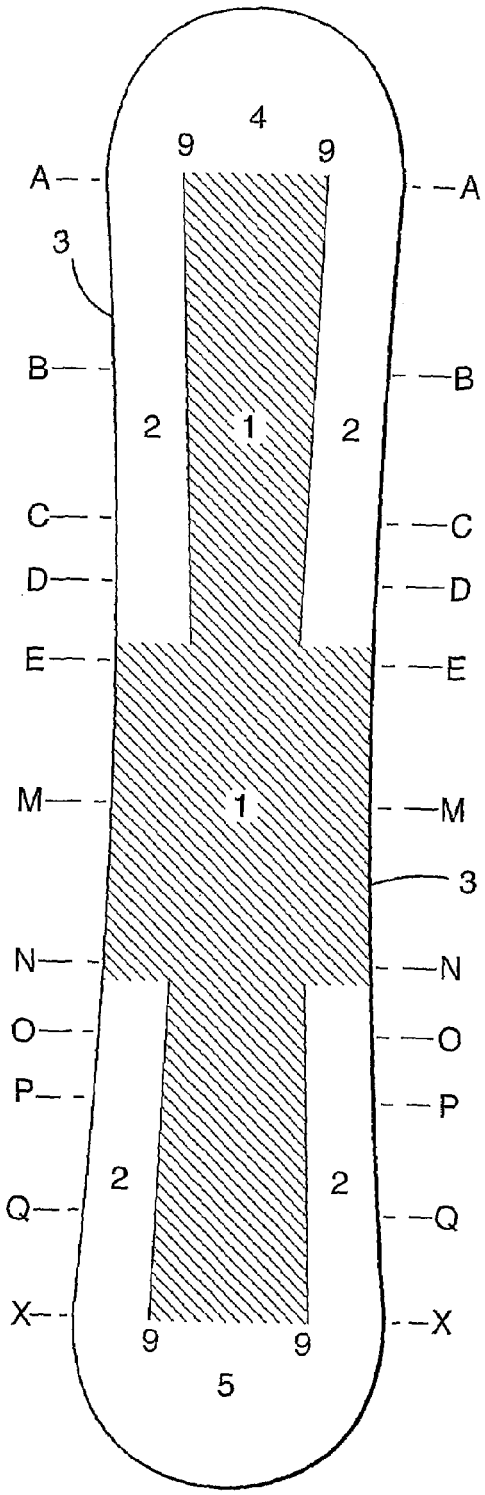
Figure 11A:
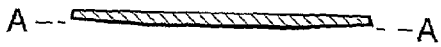
Figure 11B:
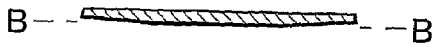
Figure 11C:
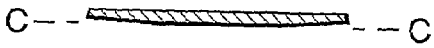
Figure 11D:
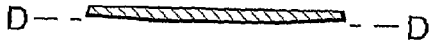
Figure 11E:
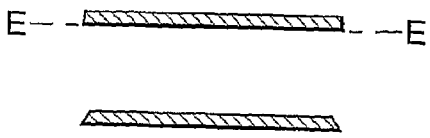
Figure 12:
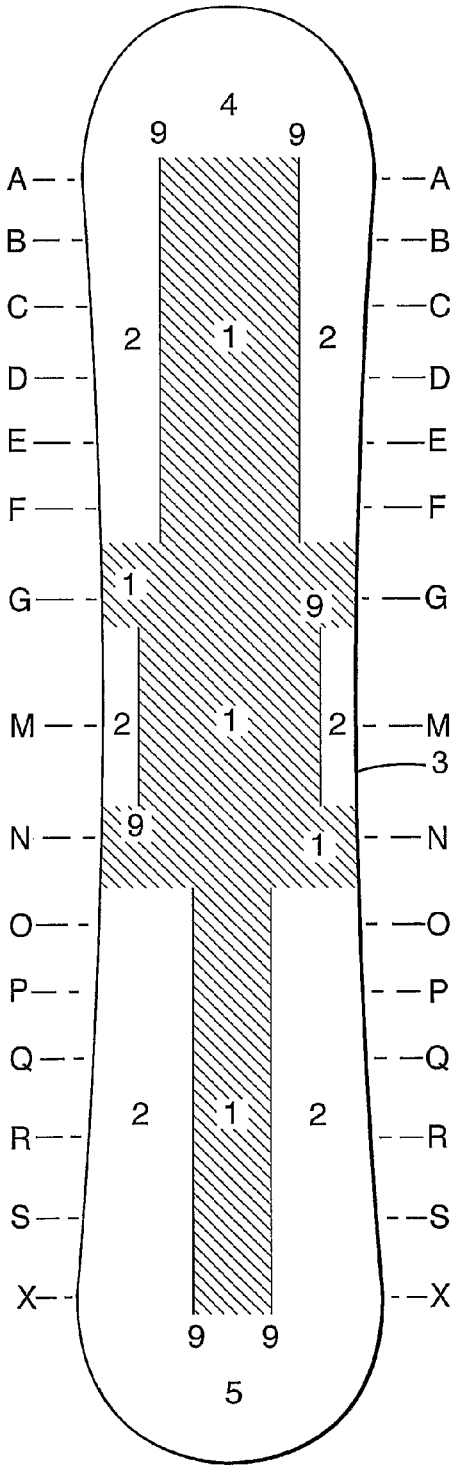
Figure 12A:
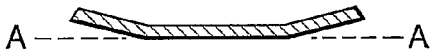
Figure 12B:
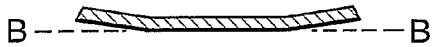
Figure 12C:
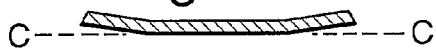
Figure 12D:
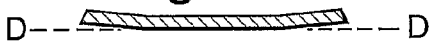
Figure 12E:
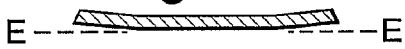
Figure 12F:
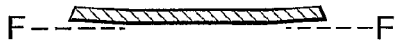
Figure 12G:
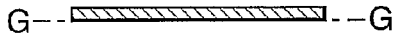
Figure 12H:
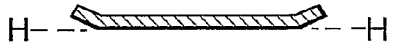
Figure 12I:
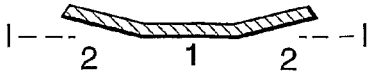
Figure 13:
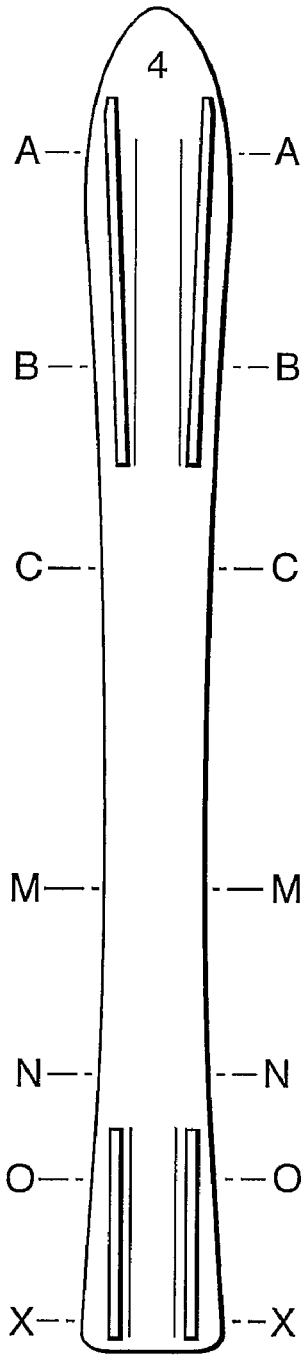
Figure 14:
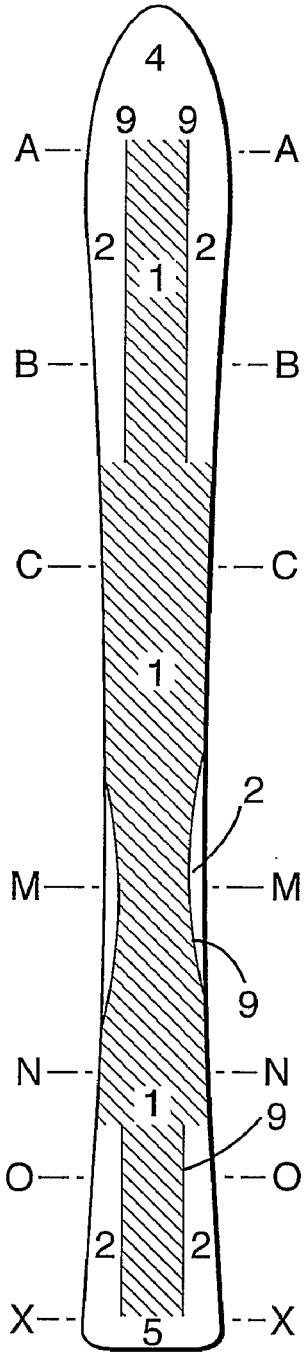
Figure 16:
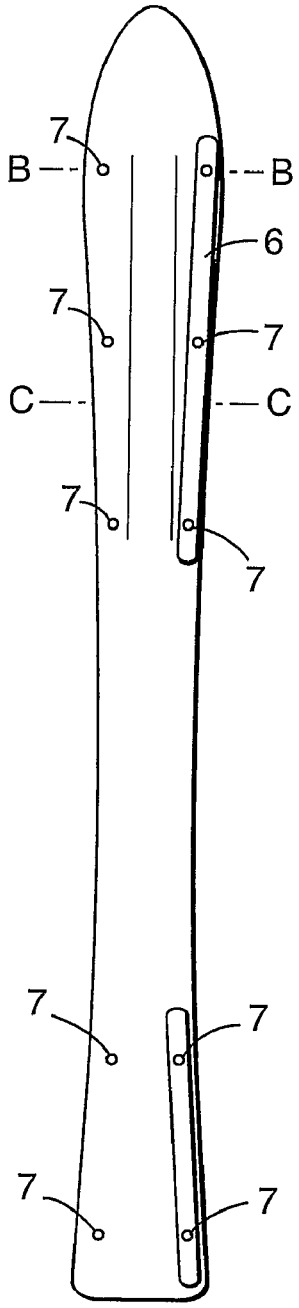
FIG. 16 illustrates a removable auxiliary strip mounted on the right side, with attachment devices for it on both sides, and where the height of the strip typically approaches zero at both ends in order to provide a uniform transition to the ski's/board's plane during sanding at ski service.
Figure 16A:
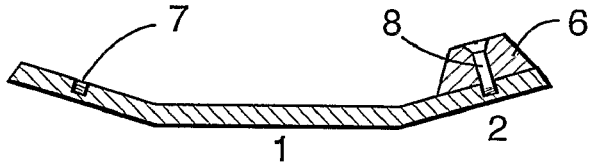
Figure 16B:
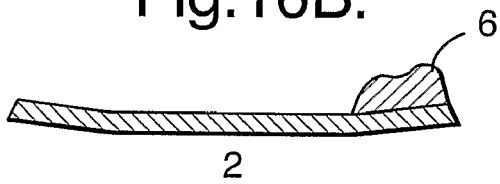

As can be seen in FIG. 11 the secondary lateral area is not symmetrical about the central transversal axis BB but in principle it could be. On the other hand it is drawn fairly symmetrically about the central longitudinal axis, but in principle it could just as well be asymmetrical. This applies to all the figures—the illustrated principle applies both to symmetrical and asymmetrical.

It is obvious that most types of known shapes for the top of the board may be combined with this invention. For example, it may be of interest to have a flat top on the board round the bindings, thus preventing the shape of the board from being influenced by the binding being mounted on the board. Since such snowboards and skis are difficult to sand, it is appropriate to provide longitudinal raised portions over the secondary sliding surfaces, thereby making it easier to use a standard sanding machine with guide wheel over the stone/sandpaper belt. Another advantage of such raised portions is that the guide wheel always has an optimal pressure distribution over the secondary lateral surfaces when the sole is sanded, provided the guide wheel presses over the raised portion on one side. This principle can then be taken a step further and an attachment device can be provided in the snowboard's or the ski's surface for a raised portion which is placed on one side only when the board/ski is to be sanded on that side and then the same profile is placed on the other side when the other side is to be sanded, removing the profile when the flat sole portion is to be sanded. These profiles will normally be supplied with the skis/board at the time of purchase.

The whole process may also be envisaged standardised, where the ski service department has these profiles in different lengths.

Ski service has bridges to place on the bindings. These bridges can be provided with raised portions on one side or the other. Alternatively, the profiles may be placed on the bridges. Easy-to-sand skis (and boards) with secondary sole surfaces are thereby obtained.

The invention is not limited to the illustrated embodiment, and many modifications will be possible within the scope of the invention.

The invention claimed is:

1. A snowboard, where the snowboard comprises a board on which two bindings mountable on the top of the board at a distance apart approximately corresponding to ⅓ of the board's length, where the board is designed with inwardly curved edge portions, so that the board has a greater width at a transition to front and rear tips of the board than in a central portion, where the tips are upwardly curved and where for a substantial length of the board, an underside of the board is designed with a first and second sole surface, which viewed in cross section are arranged at an angle to each other and generally interconnected via a surface, wherein the first and second sole surfaces at the lateral edge, which consists of a steel edge, have a varying height over a third sole surface where the varying height both increases and decreases as one advances from a middle of the board towards the transition to the tip, and at the same time the first and second sole surfaces at the lateral edge have a substantially greater height over the third surface in a 10 cm long area from the transition and backwards than in an area forming a central half in the longitudinal direction of the board where this is defined after an average uplift of the lateral edges measured in millimetres relative to the third sole surface in the respective areas on both sides, the third surface is a cambered surface across the board where the camber differs as viewed along the board's longitudinal direction and with at least one break point, the first and second straight surfaces at least in parts of their longitudinal dimension are designed with additional angled portions, in such a way that in cross section there are more than two angle lines extending along the board, that the angles between the respective surfaces are acute angles relative to the board's horizontal plane, and have different sizes along the length of the board.

2. A snowboard according to claim 1, wherein the first and second sole surfaces are divided in such a way that at least four surfaces, at an angle to one another when viewed in cross section are formed, and that the sum of the respective acute angles between the surfaces in a cross section decreases from the transition to the front tip and from the rear tip inwards towards the middle of the board, in such a manner that it increases again towards the narrowest portion at the middle of the board.

3. A snowboard according to claim 1, wherein the third surface in the board's central portion is flat and extends all the way out to the board's lateral edge in parts of the length, and the angle of the first and second lateral surfaces relative to the third sole surface increases from the middle of the board up to an area for binding attachments, and then decreases before again increasing towards the front and rear tips.

4. A snowboard according to claim 1, wherein the width of the third sole surface is variable, with a widest portion in the board's central area, which wide portion extends to a short distance from the edge of the board.

5. A snowboard according to claim 1, wherein the angle for the first and second sole surfaces is largest at the front and rear tips and substantially decreases in the direction towards an area for binding attachments, in such a manner that the angle may alternately decrease and increase while substantially decreasing, such that in the succeeding area the angle alternately increases and decreases towards the board's central portion.

6. A snowboard according to claim 1, wherein the secondary sole surface at the lateral edge has a substantially greater height over the defined third sole portion in a 10 cm long area from the transition and forwards than in the area forming the central half of the snowboard where this is defined according to average uplift of the steel edges measured in millimetres relative to the first sole surface in the respective areas on both sides.

7. A snowboard according to claim 1, wherein a substantial raising of the lateral edge in the board's narrowest area at the middle of the board is such that the, raised portion decreases towards binding attachments on the snowboard before increasing again towards the transition to the front and rear tips.

8. A snowboard according to claim 1, wherein the raising of the lateral edges in the secondary lateral areas fluctuates, constantly alternating between increasing and then decreasing slightly from the middle towards the transitions to the front and rear tips.

9. A snowboard according to claim 1, wherein the board is provided with pliable and thinner zones respectively.

10. A snowboard according to claim 1, wherein sliding surfaces are substantially symmetrical about the central longitudinal axis and the central transversal axis.

11. A snowboard according to claim 1, wherein sliding surfaces are asymmetrical about the longitudinal axis and the central transverse axis, with a different number of sliding surfaces on one side compared with the other side.

12. A snowboard according to claim 1, wherein the plane of binding attachments defines the flat third sole surface.

13. A snowboard according to claim 1, wherein the camber has continuous transitions.

14. A snowboard according to claim 4, wherein the first and second sole surfaces in the central portion are narrow relative to the third sole surface, where the first and second sole surfaces form a larger angle than at the transition to a succeeding portion where the surfaces increase in width, and the angle of the surface to the board's horizontal plane again increases and builds up towards the tips.

15. A snowboard according to claim 10, wherein the angle between the third sole surface and the first and second sole surfaces increases at binding attachments on the snowboard, before decreasing on both sides of the binding attachments, and increasing again towards the transition to the front and rear tips.

* * * * *